US008329301B2

(12) United States Patent
Wu et al.

(10) Patent No.: US 8,329,301 B2
(45) **Date of Patent: *Dec. 11, 2012**

(54) FLUOROELASTOMER CONTAINING INTERMEDIATE TRANSFER MEMBERS

(75) Inventors: Jin Wu, Webster, NY (US); Lanhui Zhang, Webster, NY (US); Lin Ma, Webster, NY (US); Jonathan H Herko, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 399 days.

This patent is subject to a terminal disclaimer.

(21) Appl. No.: 12/511,160

(22) Filed: Jul. 29, 2009

(65) Prior Publication Data

US 2011/0027709 A1 Feb. 3, 2011

(51) Int. Cl.
*G03G 13/14* (2006.01)

(52) U.S. Cl. ..... 428/421; 428/422; 399/121

(58) Field of Classification Search ..... 523/200
See application file for complete search history.

(56) References Cited

U.S. PATENT DOCUMENTS

| | | | | |
|---|---|---|---|---|
| 5,340,679 | A * | 8/1994 | Badesha et al. | 430/125.33 |
| 5,409,557 | A * | 4/1995 | Mammino et al. | 156/137 |
| 5,585,905 | A * | 12/1996 | Mammino et al. | 399/308 |
| 5,700,861 | A | 12/1997 | Tomihashi et al. | |
| 5,876,636 | A | 3/1999 | Schlueter, Jr. et al. | |
| 5,995,796 | A * | 11/1999 | Schlueter et al. | 399/313 |
| 6,397,034 | B1 | 5/2002 | Tarnawskyj et al. | |
| 6,560,435 | B1 | 5/2003 | Yamamoto et al. | |
| 6,602,156 | B2 | 8/2003 | Schlueter, Jr. | |
| 6,733,884 | B2 * | 5/2004 | Brown | 428/404 |
| 7,031,647 | B2 | 4/2006 | Mishra et al. | |
| 7,081,234 | B1 * | 7/2006 | Qi et al. | 423/592.1 |
| 7,130,569 | B2 | 10/2006 | Goodman et al. | |
| 7,139,519 | B2 | 11/2006 | Darcy, III et al. | |
| 7,280,791 | B2 | 10/2007 | Goodman et al. | |
| 2004/0109057 | A1 * | 6/2004 | Pan et al. | 347/106 |
| 2006/0167138 | A1 * | 7/2006 | Ishii et al. | 523/200 |

FOREIGN PATENT DOCUMENTS

| | | | |
|---|---|---|---|
| EP | 1 106 657 | A2 | 6/2001 |
| EP | 1 162 239 | A2 | 12/2001 |
| GB | 1 109 369 | | 4/1968 |
| JP | A-11-115117 | | 4/1999 |
| JP | A-2000-212360 | | 8/2000 |
| WO | WO 03/104319 | A1 | 12/2003 |

OTHER PUBLICATIONS

ChemicalBook, Hexamethyldisilazane, http://www.chemicalbook.com/ChemicalProductProperty_EN_CB9105784.htm, retrieved Nov. 25, 2011, pp. 1-3.*

Zhang et al., Microstructure and electrical properties of antimony-doped tin oxide thin film deposited by sol-gel process, Materials Chemistry and Physics, vol. 98, Issues 2-3, Aug. 1, 2006, pp. 353-357.*

Iwamoto et al., JP 11115117 A, Machine Translation, Apr. 1999, JPO, 1-10.*

Jun. 10, 2011 European Search Report issued in EP 10 17 0922.

Oct. 6, 2011 Office Action issued in U.S. Appl. No. 12/479,057.

European Patent Office, European Search Report, European Patent Application No. 10164257.7 dated Aug. 19, 2010, 5 pgs.

Jin Wu, U.S. Appl. No. 12/511,169 entitled Polyaniline Silanol Containing Intermediate Transfer Members, filed Jul. 29, 2009, issued as U.S. Patent No. 8,012,583.

Jin Wu et al, U.S. Appl. No. 12/511,183 entitled Polyhedral Silsesquioxane Modified Polyimide Containing Intermediate Transfer Members, filed Jul. 29, 2009.

Jin Wu, U.S. Appl. No. 12/181,354 entitled Core Shell Intermediate Transfer Components, filed Jul. 29, 2008.

Jin Wu et al, U.S. Appl. No. 12/431,829 entitled Core Shell Hydrophobic Intermediate Transfer Components, filed Apr. 29, 2009.

Jin Wu, U.S. Appl. No. 12/181,409 entitled Treated Carbon Black Intermediate Transfer Components, filed Jul. 29, 2008.

* cited by examiner

*Primary Examiner* — Callie Shosho
*Assistant Examiner* — Patrick English
(74) *Attorney, Agent, or Firm* — Eugene O. Palazzo

(57) ABSTRACT

An intermediate transfer member that includes a core shell component wherein the core is, for example, comprised of a metal oxide, and the shell is comprised of a silica, which shell contains or includes a hydrophobic agent, and where the core shell is dispersed in or mixed with a fluoroelastomer.

20 Claims, No Drawings

FLUOROELASTOMER CONTAINING INTERMEDIATE TRANSFER MEMBERS

CROSS REFERENCE TO RELATED APPLICATIONS

Illustrated in U.S. application Ser. No. 12/511,169, now U.S. Pat. No. 8,012,583, on Polyaniline Silanol Containing Intermediate Transfer Members, filed Jul. 29, 2011, the disclosure of which is totally incorporated herein by reference, is an intermediate transfer belt comprised of a core shell component, and wherein the core is comprised of a polyaniline, and the shell is comprised of polyhedral silsesquioxane.

Illustrated in U.S. application Ser. No. 12/511,183, U.S. Publication No. 20110027598, filed Jul. 29, 2009, the disclosure of which is totally incorporated herein by reference, is an intermediate transfer member comprised of a polyhedral silsesquioxane modified polyimide, and wherein said silsesquioxane is attached to said polyimide.

Illustrated in U.S. application Ser. No. 12/181,409, now U.S. Pat. No. 7,738,824, on Treated Carbon Black Intermediate Transfer Components, filed Jul. 29, 2008, the disclosure of which is totally incorporated herein by reference, is an intermediate transfer member comprised of a substrate comprising a poly(vinylalkoxysilane) surface treated carbon black.

Illustrated in U.S. application Ser. No. 12/181,354, now U.S. Pat. No. 7,985,464, on Core Shell Intermediate Transfer Components, filed Jul. 29, 2008, the disclosure of which is totally incorporated herein by reference, is an intermediate transfer belt comprised of a substrate comprising a conductive core shell component.

Illustrated in U.S. application Ser. No. 12/431,829, U.S. Publication No. 20100279094, on Core Shell Hydrophobic Intermediate Transfer Components, filed Apr. 29, 2009, the disclosure of which is totally incorporated herein by reference, an intermediate transfer belt comprised of a substrate comprising a core shell component and wherein the core is comprised of a metal oxide and the shell is comprised of silica.

BACKGROUND

Disclosed are intermediate transfer members, and more specifically, intermediate transfer members useful in transferring a developed image in an electrostatographic, for example xerographic, including digital, image on image, and the like, printers, machines or apparatuses. In embodiments, there are selected intermediate transfer members comprised of a core shell component comprised of a metal oxide core and a silica shell, and intermediate transfer members comprised of a core shell component, and which shell is hydrophobically treated with a silazane, and more specifically, a core comprised of a metal oxide and a silica shell, where the shell has added thereto a silazane, and where the core shell is dispersed in a fluorinated polymer, such as a known fluoroelastomer like VITON®, and also where the resulting hydrophobized core shell component possesses a number of advantages such as excellent resistivity, a hydrophobic surface enabling excellent image transfer and acceptable scratch resistance, excellent electrical and dimensional stability primarily because of the members water repelling characteristics, and where the intermediate transfer member surface layer can be referred to as containing superhydrophobic surfaces, which are characterized by the known lotus leaf effect and with unique properties, such as anticontamination, antisticking, and self-cleaning.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and colorant, which are commonly referred to as toner. Generally, the electrostatic latent image is developed by bringing a developer mixture into contact therewith. The developer mixture can comprise a dry developer mixture, which usually comprises carrier granules having toner particles adhering triboelectrically thereto, or a liquid developer material, which may include a liquid carrier having toner particles, dispersed therein. The developer material is advanced into contact with the electrostatic latent image, and the toner particles are deposited thereon in image configuration. Subsequently, the developed image is transferred to a copy sheet. It is advantageous to transfer the developed image to a coated intermediate transfer web, belt, or component, and subsequently transfer with a high transfer efficiency the developed image from the intermediate transfer member to a permanent substrate. The toner image is subsequently usually fixed or fused upon a support, which may be the photosensitive member itself, or other support sheet such as plain paper.

In electrostatographic printing machines wherein the toner image is electrostatically transferred by a potential difference between the imaging member and the intermediate transfer member, the transfer of the toner particles to the intermediate transfer member, and the retention thereof should be substantially complete so that the image ultimately transferred to the image receiving substrate will have a high resolution. Substantially 100 percent toner transfer occurs when most or all of the toner particles comprising the image are transferred, and little residual toner remains on the surface from which the image was transferred.

A disadvantage of using an intermediate transfer member is that a plurality of transfer steps is usually needed allowing for the possibility of charge exchange occurring between toner particles and the transfer member which ultimately can lead to less than complete toner transfer. This results in low resolution images on the image receiving substrate, and also image deterioration. When the image is in color, the image can additionally suffer from color shifting and color deterioration with a number of transfer stops.

In embodiments, the resistivity of the intermediate transfer member is within a range to allow for sufficient transfer. It is also desired that the intermediate transfer member have a controlled resistivity, wherein the resistivity is virtually unaffected by changes in humidity, temperature, bias field, and operating time. In addition, a controlled resistivity is of value so that a bias field can be established for electrostatic transfer. Also, it is of value that the intermediate transfer member not be too conductive as air breakdown can possibly occur.

In U.S. Pat. No. 6,397,034, there is disclosed the use of a fluorinated carbon filler in a polyimide intermediate transfer member layer. However, there are disadvantages associated with these members such as undissolved particles frequently bloom or migrate to the surface of the polymer layer which leads to nonuniform resistivity characteristics, which in turn causes poor antistatic properties and poor mechanical strength. Also, the ionic additives present on the surface of the belt may interfere with toner release, and bubbles may appear in the conductive polymer layer, some of which can only be seen with the aid of a microscope, others of which are large enough to be observed with the naked eye, resulting in poor or nonuniform electrical properties, and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from about 20 to 80 percent relative humidity when ionic additives are present. This effect limits the operational or process latitude of the intermediate transfer member.

Therefore, it is desired to provide a weldable intermediate transfer belt, which has excellent transfer ability. It is also desired to provide a weldable intermediate transfer belt that may not have puzzle cut seams, but instead has a weldable seam, thereby providing a belt that can be manufactured without such labor intensive steps as manually piecing together the puzzle cut seam with one's fingers, and without the lengthy high temperature and high humidity conditioning steps. It is also desired to provide an acceptable circumference weldable belt for color xerographic machines.

REFERENCES

Illustrated in U.S. Pat. No. 7,130,569 is a weldable intermediate transfer belt comprising a substrate comprising a homogeneous composition comprising a polyaniline in an amount of from about 2 to about 25 percent by weight of total solids, and a thermoplastic polyimide present in an amount of from about 75 to about 98 percent by weight of total solids, wherein the polyaniline has a particle size of from about 0.5 to about 5 microns.

Also referenced are U.S. Pat. No. 7,031,647, which illustrates an intermediate transfer belt, comprising a belt substrate comprising primarily at least one polyimide polymer; and a welded seam; and U.S. Pat. No. 7,139,519, which illustrates an image forming apparatus for forming images on a recording medium comprising:

a charge-retentive surface to receive an electrostatic latent image thereon;

a development component to apply toner to the charge-retentive surface to develop the electrostatic latent image to form a developed toner image on the charge retentive surface;

an intermediate transfer member to transfer the developed toner image from the charge retentive surface to a copy substrate, wherein the intermediate transfer member comprises a substrate comprising a first binder and lignin sulfonic acid doped polyaniline dispersion; and a fixing component to fuse the developed toner image to the copy substrate.

In U.S. Pat. No. 7,280,791 there is illustrated a weldable intermediate transfer belt comprising a substrate comprising a homogeneous composition comprising polyaniline in an amount of from about 2 to about 25 percent by weight of total solids, and thermoplastic polyimide in an amount of from about 75 to about 98 percent by weight of total solids, wherein the polyaniline has a particle size of from about 0.5 to about 5 microns.

U.S. Pat. No. 6,602,156 discloses, for example, a polyaniline filled polyimide puzzle cut seamed belt. The manufacture of a puzzle cut seamed belt is labor intensive and costly, and the puzzle cut seam, in embodiments, is sometimes weak. The manufacturing process for a puzzle cut seamed belt usually requires a lengthy high temperature and high humidity conditioning step.

SUMMARY

Included within the scope of the present disclosure is an intermediate transfer belt, and intermediate members other than belts comprised of a substrate comprising a core shell component, and more specifically, a hydrophobized core shell dispersed in a fluoroelastomer where the core is metal oxide, and the shell is comprised of a modified silica; an intermediate transfer media comprised of a substrate comprising a core and a shell thereover, and wherein the shell is comprised of a silazane containing silica, and which core shell is dispersed in a fluoroelastomer, and which core shell possesses, for example, a B.E.T. surface area of from about 30 to about 100 $m^2/g$; an intermediate transfer member comprised of a hydrophobized core shell containing fluoroelastomer surface layer where the core is metal oxide and the shell is comprised of a hydrophobized silica and a polyimide supporting substrate; a transfer media comprised of a polyimide first supporting substrate layer, and thereover a second layer comprised of a hydrophobized core shell containing fluoroelastomer, an adhesive layer situated between the first layer and the second layer, and wherein at least one of the first layer and the second layer further contains a known conductive component like carbon black, a polyaniline, a metal oxide and the like; an intermediate transfer belt comprised of a polyimide substrate layer, and thereover a layer comprised of a hydrophobized core shell containing fluoroelastomer, and wherein at least one of the substrate layer and the hydrophobized core shell containing fluoroelastomer includes a conductive component, and an apparatus for forming images on a recording medium comprising a charge retentive surface to receive an electrostatic latent image thereon;

a development component to apply toner to the charge retentive surface to develop the electrostatic latent image, and to form a developed image on the charge retentive surface; and an intermediate transfer belt to transfer the developed image from the charge retentive surface to a substrate, wherein the intermediate transfer belt comprises a fluoroelastomer dispersed conductive core shell component, wherein the shell is comprised of a silica, and which shell contains a hydrophobic substance, such as a silazane, and the like, and the core is comprised of a metal oxide.

In addition, the present disclosure provides, in embodiments, an apparatus for forming images on a recording medium comprising a charge retentive surface to receive an electrostatic latent image thereon; a development component to apply toner to the charge retentive surface to develop the electrostatic latent image, and to form a developed image on the charge retentive surface; a weldable intermediate transfer belt to transfer the developed image from the charge retentive surface to a substrate, wherein the intermediate transfer belt is as illustrated herein; and a fixing component.

EMBODIMENTS

In aspects thereof, there is disclosed herein an intermediate transfer member, such as a belt, comprised of a substrate comprising a core shell component dispersed in a fluoroelastomer, and wherein the core is comprised of a metal oxide and the shell is comprised of silica; a hydrophobic intermediate transfer media comprised of a metal oxide core and a silica shell thereover, wherein the core shell is contained in a fluoroelastomer, and wherein the shell includes a trialkyl-N-(trialkylsilyl)-silanamine; a superhydrophobic intermediate transfer media comprised of a mixture of a fluoroelastomer, a metal oxide core, and a silica shell thereover, and wherein the shell includes a trialkyl-N-(trialkylsilyl)-silanamine, and wherein the fluoroelastomer is a copolymer of vinylidene fluoride and hexafluoropropylene, a terpolymer of vinylidene fluoride, hexafluoropropylene and tetrafluoroethylene, or a tetrapolymer of vinylidene fluoride, hexafluoropropylene, tetrafluoroethylene, and a cure site monomer of 4-bromoperfluorobutene-1,1,1-dihydro-4-bromoperfluorobutene-1,3-bromoperfluoro propene-1, or 1,1-dihydro-3-bromoperfluoropropene-1; a transfer member comprised of a core shell component comprised of a metal oxide core, and a shell in which the shell is a silica, or the like, and further where the shell is hydrophobized with a silazane, a fluorosilane, a polysiloxane, and the like, and which treated core shell is dispersed in a fluoroelastomer. In embodiments, the metal oxide or doped metal oxide may be selected from the group consisting of titanium oxide, zinc oxide, tin oxide, aluminum doped zinc oxide, antimony doped titanium dioxide, antimony doped tin oxide, indium oxide, indium tin oxide, similar doped oxides, and mixtures thereof.

Examples of the hydrophobic component used to chemically treat or add to the shell include, for example, silazanes, fluorosilanes, and polysiloxanes; and which chemically treating agents are selected in an amount, for example, of from about 1 to about 15 weight percent, from about 1 to about 10 weight percent, from about 0.1 to about 12 weight percent, and other suitable amounts depending on the amounts selected for the shell.

Specific silazane examples selected for the shell are hexamethyldisilazane[1,1,1-trimethyl-N-(trimethylsilyl)-silanamine], 2,2,4,4,6,6-hexamethylcyclotrisilazane, 1,3-diethyl-1,1,3,3-tetramethyldisilazane, 1,1,3,3-tetramethyl-1,3-diphenyldisilazane, 1,3-dimethyl-1,1,3,3-tetraphenyldisilazane, represented by the following structures/formulas

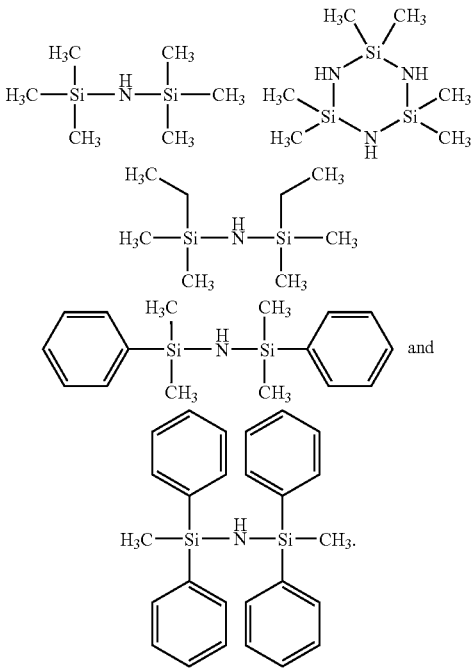

Specific fluorosilane examples selected for the shell are $C_6F_{13}CH_2CH_2OSi(OCH_3)_3$, $C_8H_{17}CH_2CH_2OSi(OC_2H_5)_3$, and the like, and mixtures thereof.

Specific polysiloxane examples selected for the shell are 2,4,6,8-tetramethylcyclotetrasiloxane, 2,4,6,8,10-pentamethylcyclopentasiloxane, octamethylcyclotetrasiloxane, decamethylcyclopentasiloxane, 2,4,6-trimethyl-2,4,6-triphenylcyclotrisiloxane, hexaphenylcyclotrisiloxane, octaphenylcyclotetrasiloxane, and the like, and mixtures thereof.

Examples of the silica selected for the shell are silica ($SiO_2$), silicone ($R_2SiO$), polyhedral oligomeric silsesquioxane (POSS, $RSiO_{1.5}$), where R is an alkyl with, for example, from about 1 to about 18 carbon atoms, or from about 4 to about 8 carbon atoms; aryl with, for example, from about 6 to about 24 carbon atoms, or from about 6 to about 16 carbon atoms, or mixtures thereof.

A specific example of the core-shell is designated as VP STX801 (B.E.T. surface area=40 to 70 $m^2/g$), commercially available from EVONIK Industries, Frankfurt, Germany. The VP STX801 comprises a titanium dioxide core (85 weight percent) and a silica shell (15 weight percent), which shell is hydrophobically modified with 1,1,1-trimethyl-N-(trimethylsilyl)-silanamine, or hexamethyldisilazane. Generally, the metal oxide core is selected in an amount of from about 50 to about 99 percent by weight, from about 65 to about 95 percent by weight, from about 80 to about 90 percent by weight, and yet more specifically, about 85 percent by weight, and the shell is present in an amount of from about 1 to about 50 percent by weight, from about 5 to about 40, from about 10 to about 30, from about 15 to about 20 percent by weight, and more specifically, about 15 percent by weight. The chemically treating component can be selected in various effective amounts, such as for example, from about 0.1 to about 40 percent by weight, from about 1 to about 30 percent by weight, or from about 10 to about 20 percent by weight.

In embodiments, the core shell possesses a B.E.T. surface area of from about 10 to about 200 $m^2/g$, from about 30 to about 100 $m^2/g$, or from about 40 to about 70 $m^2/g$.

The core shell component possesses a particle size of, for example, from about 5 to about 1,000 nanometers, from about, for example, 10 to about 200 nanometers, or from about 20 to about 100 nanometers.

The core shell filler is present in an amount of, for example, from about 3 to about 60 weight percent, from about 1 to about 50 weight percent, or from about 20 to about 40 weight percent based on the intermediate transfer member components.

The core shell product component of the present disclosure may be formed into a dispersion with a fluoroelastomer, which with mechanical stirring results in uniform dispersions, and then coated on the supporting substrate using draw bar coating methods. The resulting coated films can be dried by heating at temperatures such as from about 100° C. to about 400° C., for about 20 to about 600 minutes while remaining on the substrate. After drying and cooling to room temperature, the about 1 to about 150 microns thick films formed on the substrate to enable functional intermediate transfer members.

Fluoroelastomer examples include, for example, copolymers and terpolymers of vinylidene fluoride, hexafluoropropylene and tetrafluoroethylene. The VITON® designation is a Trademark of E.I. E.I. DuPont de Nemours, Inc. Known fluoroelastomers, which can be selected to disperse the core shell, are comprised of copolymers of vinylidene fluoride (VF2) and hexafluoropropylene (HFP), known commercially as VITON® A, terpolymers of vinylidene fluoride, hexafluoropropylene and tetrafluoroethylene (TFE), known commercially as VITON® B, F, GBL, GLT, GFLT, ETP and GF. The fluoroelastomer can further include a cure site monomer selected from those commercially available from E.I. E.I. DuPont, such as 4-bromoperfluorobutene-1,1,1-dihydro-4-bromoperfluorobutene-1,3-bromo perfluoropropene-1,1,1-dihydro-3-bromoperfluoropropene-1, or any other suitable known commercially available cure site monomers. The curable fluoroelastomers can be vulcanized with diamine curatives, bisphenol AF curatives, and/or peroxide curatives.

Specific fluoroelastomer examples that can be used include VITON® A-201C, A-331C, A-361C, A-401C, A-601C, A-100, A-200, A-500, A-700, A-HV, AL-300, AL-600, B-435C, B-601C, B-651C, GBL-200S, GBL-600S, B-202, B-600, F-605C, GF-200S, GF-600S, GLT-200S, GLT-600S, GBLT-200S, GBLT-600S, GFLT-200S, GFLT-600S, and ETP-600S. More specifically, VITON® GF is comprised of 35 mole percent of vinylidene fluoride, 34 mole percent of hexafluoropropylene, and 29 mole percent of tetrafluoroethylene with 2 mole percent cure site monomer.

In addition to known suitable substrates, in embodiments there are selected polyimides, which may be synthesized from prepolymer solutions, such as polyamic acid or esters of polyamic acid, or by the reaction of a dianhydride and a diamine. Suitable dianhydrides include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl)hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)ether dianhydride, di-(4-(3,4-dicarboxyphenoxy)phenyl)sulfide dianhydride, di-(3,4-dicarboxyphenyl)methane dianhydride, di-(3,4-dicarboxyphenyl)ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy)diphthalic dianhydride, 4,4'-diphenylsulfidedioxybis(4-phthalic acid) dianhydride, 4,4'-diphenylsulfonedioxybis(4-phthalic acid) dianhydride, methylenebis(4-phenyleneoxy-4-phthalic acid) dianhydride, ethylidenebis(4-phenyleneoxy-4-phthalic acid) dianhydride, isopropylidenebis-(4-phenyleneoxy-4-phthalic acid)dianhydride, hexafluoroisopropylidenebis(4-phenyleneoxy-4-phthalic acid)dianhydride, and the like. Exemplary diamines suitable for use in the preparation of the polyimide include aromatic diamines such as 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl]sulfide, bis[4-(3-aminophenoxy)phenyl]sulfone, bis[4-(3-aminophenoxy)phenyl]ketone, 4,4'-bis(3-aminophenoxy)biphenyl, 2,2-bis[4-(3-aminophenoxy)phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, and 2,2-di(p-aminophenyl)-1,1,1,3,3,3-hexafluoropropane.

The dianhydrides and diamines are, for example, selected in a weight ratio of dianhydride to diamine of from about 20:80 to about 80:20, and more specifically, in an about 50:50 weight ratio. The above aromatic dianhydride like aromatic tetracarboxylic acid dianhydrides and diamines like aromatic diamines are used singly or as a mixture, respectively. The polyimide can be prepared from the dianhydride and diamine by known methods. For example, the dianhydride and the diamine can be suspended, or dissolved in an organic solvent as a mixture, or separately, and can be reacted to form the polyamic acid, which is thermally or chemically dehydrated with the product being separated and purified. The polyimide may be heat melted with a known extruder, delivered in the form of a film from a die having a slit nozzle, and then a static charge is applied to the film; the film is cooled and solidified with a cooling roller having a surface temperature in the range of the glass transition temperature ($T_g$) of the polyimide, transmitted under tension without contacting the film with rollers while further cooling to room temperature, and wound up or transferred to the next operation.

Examples of thermosetting polyimides that can be incorporated into the intermediate transfer member include known low temperature and rapidly cured polyimide polymers, such as VTEC™ PI 1388, 080-051, 851, 302, 203, 201, and PETI-5, all available from Richard Blaine International, Incorporated, Reading, Pa. These thermosetting polyimides which can be cured at temperatures of from about 180° C. to about 260° C. over a short period of time, such as from about 10 to about 120 minutes, or from about 20 to about 60 minutes, possess a number average molecular weight of from about 5,000 to about 500,000, or from about 10,000 to about 100,000, and a weight average molecular weight of from about 50,000 to about 5,000,000, or from about 100,000 to about 1,000,000. Other thermosetting polyimides that can be selected for the ITM or ITB, and cured at temperatures of above 300° C. include PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100 commercially available from FUJIFILM Electronic Materials U.S.A., Inc., North Kingstown, R.I.; and KAPTON® HN, VN and FN, all commercially available from E.I. E.I. DuPont, Wilmington, Del.; a polyimide prepared by reacting di-(2,3-dicarboxyphenyl)-ether dianhydride with 5-amino-1-(p-aminophenyl)-1,3,3-trimethylindane, available as Polyimide XU 218 from Ciba-Geigy Corporation, Ardsley, N.Y.

In embodiments, the polyimide supporting substrate first layer has deposited thereon the core shell component illustrated herein like those formed from various diamines and dianhydrides, such as polyimide, polyamideimide, polyetherimide, and the like. Polyimides include aromatic polyimides such as those formed by the reacting pyromellitic acid and diaminodiphenylether, or by imidization of copolymeric acids such as biphenyltetracarboxylic acid and pyromellitic acid with two aromatic diamines such as p-phenylenediamine and diaminodiphenylether; pyromellitic dianhydride and benzophenone tetracarboxylic dianhydride copolymeric acids reacted with 2,2-bis[4-(8-aminophenoxy)phenoxy]-hexafluoropropane; and aromatic polyimides including those that contain 1,2,1',2'-biphenyltetracarboximide and paraphenylene groups, and those having biphenyltetracarboximide functionality with diphenylether end spacer characterizations.

Examples of polyamideimide substrates can be synthesized by at least the following two methods (1) isocyanate method which involves the reaction between an isocyanate and a trimellitic anhydride; or (2) the acid chloride method where there is reacted a diamine and a trimellitic anhydride chloride. Examples of polyamideimides include VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON Al-10 ($T_g$=272° C.), commercially available from Solvay Advanced Polymers, LLC, Alpharetta, Ga.

Examples of additional components present in the intermediate transfer member, such as being present in the core shell fluoroelastomer mixture or the polyimide substrate, are a number of known conductive components selected in an amount of from about 1 to about 60, from about 1 to about 35, from about 1 to about 20, from 1 to about 10 weight percent, such as metal oxide, polyaniline and carbon black.

Examples of metal oxides include titanium oxide, zinc oxide, tin oxide, aluminum doped zinc oxide, antimony doped titanium dioxide, antimony doped tin oxide, indium oxide, indium tin oxide, similar doped oxides, and mixtures thereof.

In embodiments, the polyaniline added conductive component has a relatively small particle size of from about 0.5 to about 5 microns, from about 1.1 to about 2.3 microns, from about 1.2 to about 2 microns, from about 1.5 to about 1.9 microns, or about 1.7 microns. Specific examples of polyanilines selected are PANIPOL™ F, commercially available from Panipol Oy, Finland; and lignosulfonic acid grafted polyanilines.

Carbon blacks can also be selected as a conductive component, and where carbon black surface groups can be formed by oxidation with an acid or with ozone, and where there is absorbed or chemisorbed oxygen groups from, for example, carboxylates, phenols, and the like. The carbon surface is essentially inert to most organic reaction chemistry except primarily for oxidative processes, and free radical reactions.

The conductivity of carbon black is dependent on surface area and its structure primarily. Generally, the higher surface area and the higher structure, the more conductive the carbon black. Surface area is measured by the B.E.T. nitrogen surface area per unit weight of carbon black, and is the measurement of the primary particle size. Structure is a complex property that refers to the morphology of the primary aggregates of carbon black. It is a measure of both the number of primary particles comprising primary aggregates, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks selected as the conductive component include VULCAN® carbon blacks, REGAL® carbon blacks, MONARCH® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area35 $m^2/g$, DBP absorption=1.22 ml/g), VULCAN® XC72 (B.E.T. surface area=254 $m^2/g$, DBP absorption=1.76 ml/g), VULCAN ® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers).

Channel carbon blacks available from Evonik-Degussa; Special Black 4 (B.E.T. surface area=180 $m^2/g$, DBP absorption=1.8 ml/g, primary particle diameter=25 nanometers), Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), and Color Black FW200 (B.E.T. surface area=460 $m^2/g$, DBP absorption=4.6 ml/g, primary particle diameter=13 nanometers).

In embodiments, a doped metal oxide core of the core shell component refers, for example, to mixed metal oxides with at least two metals. Thus, for example, the antimony tin oxide comprises less than or equal to about 50 percent of antimony oxide, and the remainder is tin oxide; and a tin antimony oxide comprises less than or equal to about 50 percent of tin oxide, and the remainder is antimony oxide.

Generally, in embodiments the core antimony tin oxide can be represented by $Sb_xSn_yO_z$, wherein x is, for example, from about 0.02 to about 0.98, y is from about 0.51 to about 0.99, and z is from about 2.01 to about 2.49, and more specifically, wherein this oxide is comprised of from about 1 to about 49 percent of $Sb_2O_3$ and from about 51 to about 99 percent of $SnO_2$. In embodiments, x is from about 0.40 to about 0.90, y is from about 0.70 to about 0.95, and z is from about 2.10 to about 2.35; and more specifically, x is about 0.75, y is about 0.45, and z about 2.25; and wherein the core is comprised of from about 1 to about 49 percent of antimony oxide, and from about 51 to about 99 percent of tin oxide, from about 15 to about 35 percent of antimony oxide, and from about 85 to about 65 percent of tin oxide, and wherein the total thereof is about 100 percent; or from about 40 percent of antimony oxide, and about 60 percent of tin oxide, and wherein the total thereof is about 100 percent.

Adhesive layer components for the plural layered member, and which adhesive layer is usually situated between the supporting substrate and the top curve shell layer thereover include, for example, a number of resins or polymers such as epoxy, urethane, silicone, polyester, and the like. Generally, the adhesive layer is a solventless layer that is materials that are liquid at room temperature (about 25° C.) and are able to crosslink to an elastic or rigid film to adhere at least two materials together. Specific adhesive layer examples include 100 percent solids adhesives including polyurethane adhesives obtained from Lord Corporation, Erie, Pa., such as TYCEL® 7924 (viscosity from about 1,400 to about 2,000 cps), TYCEL® 7975 (viscosity from about 1,200 to about 1,600 cps) and TYCEL® 7276. The viscosity range of the adhesives is, for example, from about 1,200 to about 2,000 cps. The solventless adhesives can be activated with either heat, room temperature curing, moisture curing, ultraviolet radiation, infrared radiation, electron beam curing, or any other known technique. The thickness of the adhesive layer is usually less than about 100 nanometers, and more specifically, as illustrated hereinafter.

The thickness of each layer of the intermediate transfer member can vary and is not limited to any specific value. In specific embodiments, the substrate layer thickness is, for example, from about 20 to about 300 microns, from about 30 to about 200 microns, from about 75 to about 150 microns, from about 50 to about 100 microns, while the thickness of the top core shell containing fluoroelastomer layer is, for example, from about 1 to about 150 microns, from about 10 to about 100 microns, from about 20 to about 70 microns, and from about 30 to about 50 microns. The adhesive layer thickness is, for example, from about 1 to about 100 nanometers, from about 5 to about 75 nanometers, or from about 50 to about 100 nanometers.

The surface resistivity of the intermediate transfer members disclosed herein is, for example, from about $10^8$ to about $10^{13}$ ohm/sq, or from about $10^{10}$ to about $10^{12}$ ohm/sq. The sheet resistivity of the intermediate transfer members is, for example, from about $10^8$ to about $10^{13}$ ohm/sq, or from about $10^{10}$ to about $10^{12}$ ohm/sq.

The intermediate transfer members illustrated herein, like intermediate transfer belts, can be selected for a number of printing and copying systems, inclusive of xerographic printing. For example, the disclosed intermediate transfer members can be incorporated into a multi-imaging system where each image being transferred is formed on the imaging or photoconductive drum at an image forming station, wherein each of these images is then developed at a developing station, and transferred to the intermediate transfer member. The images may be formed on the photoconductor and developed sequentially, and then transferred to the intermediate transfer member. In an alternative method, each image may be formed on the photoconductor or photoreceptor drum, developed, and transferred in registration to the intermediate transfer member. In an embodiment, the multi-image system is a color copying system, wherein each color of an image being copied is formed on the photoreceptor drum, developed, and transferred to the intermediate transfer member.

After the toner latent image has been transferred from the photoreceptor drum to the intermediate transfer member, the intermediate transfer member may be contacted under heat and pressure with an image receiving substrate such as paper. The toner image on the intermediate transfer member is then transferred and fixed, in image configuration, to the substrate such as paper.

The intermediate transfer member present in the imaging systems illustrated herein, and other known imaging and printing systems, may be in the configuration of a sheet, a web, a belt, including an endless belt, an endless seamed flexible belt, and an endless seamed flexible belt; a roller, a film, a foil, a strip, a coil, a cylinder, a drum, an endless strip, and a circular disc, and where the circumference of the transfer member of 1 to 2 or more layers is, for example, from about 250 to about 2,500 millimeters, from about 1,500 to about 2,500 millimeters, or from about 2,000 to about 2,200 millimeters. The width of the transfer member is, for example, from about 100 to about 1,000 millimeters, from about 200 to about 500 millimeters, or from about 300 to about 400 millimeters.

Specific embodiments will now be described in detail. These examples are intended to be illustrative, and the disclosure is not limited to the materials, conditions, or process parameters set forth in these embodiments. All parts are percentages by weight of total solids unless otherwise indicated.

EXAMPLE I

Preparation of a Dual Layer Intermediate Transfer Member Comprising a Polyimide Base Layer and a Core Shell Containing Fluoroelastomer Surface Layer A polyimide base layer was prepared as follows. One gram of Color Black FW1 (B.E.T. surface area=320 $m^2$/g, DBP absorption=2.89 ml/g, primary particle diameter=13 nanometers) as obtained from Evonik-Degussa, was mixed with 26.25 grams of a polyamic acid (polyimide precursor) solution, VTEC™ PI 1388 (20 weight percent solution in N-methylpyrrolidone, $T_g$>320° C.), obtained from Richard Blaine International, Incorporated. By ball milling the aforementioned mixture with 2 millimeter stainless shot via an Attritor for 1 hour, a uniform dispersion was obtained. The resulting dispersion was then coated on a glass plate using a known draw bar coating method. Subsequently, the film obtained was dried at 100° C. for 20 minutes while remaining on the glass plate.

The core shell fluoroelastomer surface layer was prepared as follows. One gram of the core shell filler VP STX801 [B.E.T. surface area equal to about 40 to 70 $m^2$/g, comprising a titanium dioxide core (85 percent) and a silica shell (15 percent), which shell was hydrophobically modified with 1,1,1-trimethyl-N-(trimethylsilyl)-silanamine), commercially available from EVONIK Industries, was mixed with 2.23 grams of VITON® GF, a tetrapolymer of 35 mole percent of vinylidene fluoride, 34 mole percent of hexafluoropropylene, and 29 mole percent of tetrafluoroethylene with 2 mole percent of the cure site monomer of 4-bromoperfluorobutene-1; 1,1-dihydro-4-bromoperfluorobutene-1,3-bromoperfluoro propene-1; or 1,1-dihydro-3-bromoperfluoropropene-1 (not revealed by E.I. DuPont which one of these cure site monomers was selected), available from E.I. DuPont, 0.1 gram of a bisphenol AF curative VC50, also available from E.I. DuPont, and 25.4 grams of methyl isobutyl ketone (MIBK). By ball milling this mixture with 2 millimeters of stainless shot overnight, 23 hours, a uniform dispersion was obtained. The dispersion was then coated on the above polyimide base layer present on the glass plate using the known draw bar coating method. Subsequently, the resulting dual layer film obtained was dried at 49° C. for 2 hours, 177° C. for 2 hours, 204° C., and post cured at 232° C. for 6 hours while remaining on the glass plate.

The dual layer film on the glass plate was then immersed into water overnight, about 23 hours, and a freestanding film was released from the glass automatically resulting in a dual layer intermediate transfer member with a 75 micron thick carbon black/polyimide base layer with a ratio by weight of 16 carbon black and 84 polyimide, and a 20 micron thick of the above core shell filler/VITON® GF/curative VC50 surface layer with a ratio by weight of 30 core shell filler, 67 VITON® GF, and 3 of the above curative VC50.

EXAMPLE II

Preparation of a Dual Layer Intermediate Transfer Member Comprising a Polyimide Base Layer, and a Core Shell Containing Fluoroelastomer Surface Layer The polyimide base layer was prepared as follows. One gram of Color Black FW1 (B.E.T. surface area=320 $m^2/g$, DBP absorption=2.89 ml/g, primary particle diameter=13 nanometers) from Evonik-Degussa, was mixed with 26.25 grams of a polyamic acid (polyimide precursor) solution, VTEC™ PI 1388 (20 weight percent solution in N-methylpyrrolidone, $T_g$>320° C.), obtained from Richard Blaine International, Incorporated. By ball milling this mixture with 2 millimeter stainless shot via an Attritor for 1 hour, a uniform dispersion was obtained. The dispersion was then coated on a glass plate using the known draw bar coating method. Subsequently, the film obtained was dried at 100° C. for 20 minutes while remaining on the glass plate.

The core shell fluoroelastomer surface layer was prepared as follows. One gram of the core shell filler VP STX801, B.E.T. surface area equal to about 40 to 70 $m^2/g$, comprising a titanium dioxide core (85 percent) and a silica shell (15 percent), which shell was hydrophobically modified with 1,1,1-trimethyl-N-(trimethylsilyl)-silanamine), commercially available from EVONIK Industries, was mixed with 1.44 grams of VITON® GF, a tetrapolymer of 35 mole percent of vinylidene fluoride, 34 mole percent of hexafluoropropylene and 29 mole percent of tetrafluoroethylene with 2 mole percent of the Example I cure site monomer available from E.I. DuPont, 0.065 gram of the bisphenol AF curative VC50, also available from E.I. DuPont, and 25.4 grams of methyl isobutyl ketone (MIBK). By ball milling this mixture with 2 millimeters of stainless shot overnight, 23 hours, a uniform dispersion was obtained. The dispersion was then coated on the above polyimide base layer present on the glass plate using the above draw bar coating method. Subsequently, the resulting dual layer film obtained was dried at 49° C. for 2 hours, 177° C. for 2 hours, 204° C. and post cured at 232° C. for 6 hours while remaining on the glass plate.

The dual layer film on the glass was then immersed into water overnight, about 23 hours, and the freestanding film was released from the glass automatically resulting in a dual layer intermediate transfer member with a 75 micron thick carbon black/polyimide base layer with a ratio by weight of 16 carbon black and 84 polyimide, and a 20 micron thick of the above core shell filler/VITON® GF/curative VC50 surface layer with a ratio by weight of 40 core shell filler, 57.4 VITON® GF, and 2.6 of the above curative VC50.

EXAMPLE III

Preparation of a Single Layer Core Shell Containing Fluoroelastomer Intermediate Transfer Member One gram of the core shell filler VP STX801, B.E.T. surface area equal to about 40 to 70 $m^2/g$, comprising a titanium dioxide core (85 percent) and a silica shell (15 percent), which shell is hydrophobically modified with 1,1,1-trimethyl-N-(trimethylsilyl)-silanamine), commercially available from EVONIK Industries, was mixed with 2.23 grams of VITON® GF, a tetrapolymer of 35 mole percent of vinylidene fluoride, 34 mole percent of hexafluoropropylene, and 29 mole percent of tetrafluoroethylene with 2 mole percent of the cure site monomer of Example I, available from E.I. DuPont, 0.1 gram of the above bisphenol AF curative VC50, also available from E.I. DuPont, and 25.4 grams of methyl isobutyl ketone (MIBK). By ball milling this mixture with 2 millimeters of stainless shot overnight, 23 hours, a uniform dispersion was obtained. The dispersion was then coated on a glass plate using the above draw bar coating method. Subsequently, the resulting film obtained was dried at 49° C. for 2 hours, 177° C. for 2 hours, 204° C. and post cured at 232° C. for 6 hours while remaining on the glass plate.

The film on the glass was then immersed into water overnight, about 23 hours, and a freestanding film was released from the glass automatically resulting in a single layer intermediate transfer member with a 75 micron thick core shell filler/VITON® GF/curative VC50 layer with a ratio by weight of 30 core shell filler, 67 VITON® GF, and 3 curative VC50.

EXAMPLE IV

Preparation of a Single Layer Core Shell Containing Fluoroelastomer Intermediate Transfer Member One gram of the core shell filler VP STX801, B.E.T. surface area equal to about 40 to 70 $m^2/g$, comprising a titanium dioxide core (85 percent) and a silica shell (15 percent), which shell is hydrophobically modified with 1,1,1-trimethyl-N-(trimethylsilyl)-silanamine), commercially available from EVONIK Industries, was mixed with 1.44 grams of VITON® GF, a tetrapolymer of 35 mole percent of vinylidene fluoride, 34 mole percent of hexafluoropropylene, and 29 mole percent of tetrafluoroethylene with 2 mole percent of the cure site monomer of Example I, available from E.I. DuPont, 0.065 gram of the above bisphenol AF curative VC50, also available from E.I. DuPont, and 25.4 grams of methyl isobutyl ketone (MIBK). By ball milling this mixture with 2 millimeters of stainless shot overnight, 23 hours, a uniform dispersion was obtained. The dispersion was then coated on the glass plate using the above draw bar coating method. Subsequently, the resulting film obtained was dried at 49° C. for 2 hours, 177° C. for 2 hours, 204° C. and post cured at 232° C. for 6 hours while remaining on the glass plate.

The film on the glass was then immersed into water overnight, about 23 hours, and a freestanding film was released from the glass automatically resulting in a single layer intermediate transfer member with a 75 micron thick core shell filler/VITON® GF/curative VC50 layer with a ratio by weight of 40 core shell filler, 57.4 VITON® GF and 2.6 curative VC50.

COMPARATIVE EXAMPLE 1

Preparation of a Single Layer Fluoroelastomer Intermediate Transfer Member

Three grams of VITON® GF, a tetrapolymer of 35 mole percent of vinylidene fluoride, 34 mole percent of hexafluoropropylene, and 29 mole percent of tetrafluoroethylene with 2 mole percent of the above cure site monomer, available from E.I. DuPont, and 0.13 gram of the above bisphenol AF curative VC50, also available from E.I. DuPont, were mixed with 20.9 grams of methyl isobutyl ketone (MIBK). The solution was then coated on the glass plate using a draw bar coating method. Subsequently, the resulting film obtained was dried at 49° C. for 2 hours, 177° C. for 2 hours, 204° C. and post cured at 232° C. for 6 hours while remaining on the glass plate.

The film on the glass was then immersed into water overnight, about 23 hours, and a freestanding film was released from the glass automatically resulting in a single layer intermediate transfer member with a 75 micron thick VITON® GF/curative VC50 layer with a ratio by weight of 95.7 VITON® GF and 4.3 of the above curative VC50.

Surface Resistivity Measurement

The above ITB members or devices of Examples I and II were measured for surface resistivity (averaging four to six measurements at varying spots, 72° F./65 percent room humidity) using a High Resistivity Meter (Hiresta-Up MCP-HT450 from Mitsubishi Chemical Corp.). The results are provided in Table 1.

TABLE 1

| | Surface Resistivity (ohm/sq) |
|---|---|
| Example I Comprising 30 Weight Percent of the Core Shell Filler and the Fluoroelastomer Surface Layer | $4.29 \times 10^{11}$ |
| Example II Comprising 40 Weight Percent of the Core Shell Filler and the Fluoroelastomer Surface Layer | $6.32 \times 10^{8}$ |

Functional intermediate transfer members were obtained with the disclosed core shell fluoroelastomer surface layers deposited on the polyimide base layers. The surface resistivity varied from about $10^8$ to about $10^{11}$ ohm/sq when about 30 to about 40 weight percent of the conductive core shell filler was present as the surface layer.

Contact Angle Measurement

The contact angles of water (in deionized water) of the ITB devices of Comparative Example 1 and Examples III and IV were measured at ambient temperature (about 23° C.), using the Contact Angle System OCA (Dataphysics Instruments GmbH, model OCA15). At least ten measurements were performed, and their averages are reported in Table 2.

TABLE 2

| | Contact Angle |
|---|---|
| Comparative Example 1 Comprising the Fluoroelastomer Layer | 104° |
| Example III Comprising 30 Weight Percent of the Core Shell Filler in the Fluoroelastomer Layer | 143° |

TABLE 2-continued

| | Contact Angle |
|---|---|
| Example IV Comprising 40 Weight Percent of the Core Shell Filler in the Fluoroelastomer Layer | 148° |

The disclosed Example III and Example IV ITB devices exhibited about 40° to 44° higher contact angles than the Comparable Example 1 ITB device, which higher angles will result in improved toner transfer and improved cleaning. The contact angle of Example IV approached a superhydrophobic state (about 150°), which enables a self cleaning ITB device. In addition, due to their hydrophobic nature, the disclosed ITB devices of Examples III and IV are expected to have improved electrical characteristics, and excellent dimensional stability as compared to the Comparative Example ITB device.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member consisting of and in sequence, a supporting substrate, an adhesive layer, and thereover a layer consisting of a conductive component a core shell component dispersed in a fluoroelastomer, and wherein the core consists of titanium oxide and the shell consists of silica chemically modified with a trialkyl-N-(trialkylsilyl)-silanamine, wherein said core shell component is present in an amount of from about 1 to about 60 percent by weight based on the weight of total solids, and said fluoroelastomer is present in an amount of from about 99 to about 40 percent by weight, and wherein said member accepts a xerographic developed image from a photoconductor, and wherein said developed image is subsequently transferred to a substrate.

2. An intermediate transfer member in accordance with claim 1 wherein said trialkyl-N-(trialkylsilyl)-silanamine is 1,1,1-trimethyl-N-(trimethylsilyl)-silanamine.

3. An intermediate transfer member in accordance with claim 1 wherein said trialky-N-(trialkylsilyl)-silanamine is selected from the group consisting of hexamethyldisilazane, 2,2,4,4,6,6-hexamethylcyclotrisilazane, 1,3-diethyl-1,1,3,3-tetramethyldisilazane, 1,1,3,3-tetramethyl-1,3-diphenyldisilazane, 1,3-dimethyl-1,1,3,3-tetraphenyl disilazane, and mixtures thereof.

4. An intermediate transfer member in accordance with claim 1 wherein said core shell component possesses a B.E.T. surface area of from about 10 to about 200 $m^2/g$.

5. An intermediate transfer member in accordance with claim 1 wherein said core shell component possesses a B.E.T. surface area of from about 30 to about 100 m2/g.

6. An intermediate transfer member in accordance with claim 1 wherein said core shell component is present in an amount of from about 20 to about 40 percent by weight based on the weight of total solids, and said fluoroelastomer is present in an amount of from about 80 to about 60 percent by weight.

7. An intermediate transfer member in accordance with claim 1 wherein said fluoroelastomer is a copolymer of vinylidene fluoride and hexafluoropropylene, a terpolymer of vinylidene fluoride, hexafluoropropylene, and tetrafluoroethylene, or a tetrapolymer of vinylidene fluoride, hexafluoropropylene, tetrafluoroethylene and a cure site monomer.

8. An intermediate transfer member in accordance with claim 7 wherein said cure site monomer is selected from the group consisting of 4-bromoperfluorobutene-1, 1,1-dihydro-4-bromoperfluorobutene-1, 3-bromoperfluoro propene-1, 1,1-dihydro-3-bromoperfluoropropene-1, and mixtures thereof.

9. An intermediate transfer member in accordance with claim 1 wherein said fluoroelastomer consists of a tetrapotymer of vinylidene fluoride, hexafluoropropylene, tetrafluoroethylene, and a cure site monomer of 4-bromoperfluorobutene-1, 1,1-dihydro-4-bromoperfluorobutene-1, 3-bromoperfluoro propene-1, or 1,1-dihydro-3-bromoperfluoropropene-1, and wherein said vinylidene fluoride is present in an amount of from about 25 to about 45 mole percent; said hexafluoropropylene is present in an amount of from about 24 to about 44 mole percent; said tetrafluoroethylene is present in an amount of from about 19 to about 39 mole percent, and said cure site monomer is present in an amount of from about 0.5 to about 5 mole percent, and the total thereof of said components is about 100 percent.

10. An intermediate transfer member in accordance with claim 1 said core shell is of a diameter of from about 5 to about 1,000 nanometers.

11. An intermediate transfer member in accordance with claim 1 wherein said conductive component is at least one of a polyaniline, a carbon black, a metal oxide, and mixtures thereof, each present in an amount of from about 1 to about 60 percent by weight based on the weight of total solids.

12. An intermediate transfer member in accordance with claim 1 wherein said member has a surface resistivity of from about $10^8$ to about $10^{13}$ ohm/sq.

13. An intermediate transfer member in accordance with claim 12 wherein said surface resistivity is from about $10^{10}$ to about $10^{12}$ ohm/sq.

14. An intermediate transfer member in accordance with claim 1 wherein said member has a circumference of from about 250 to about 2,500 millimeters.

15. An intermediate transfer member in accordance with claim 1 wherein said core is present in an amount of from about 50 to about 99 weight percent, and said shell is present in an amount of from about 1 to about 50 weight percent of said core shell component.

16. An intermediate transfer member in accordance with claim 1 wherein said core is present in an amount of from about 70 to about 90 weight percent, and said shell is present in an amount of from about 10 to about 30 weight percent of said core shell component, and wherein said trialkyl-N-(trialkylsilyl)-silanamine is 1,1,1-trimethyl-N-(trimethylsilyl)-silanamine.

17. An intermediate transfer member in accordance with claim 16 wherein said 1,1,1-trimethyl-N-(trimethylsilyl)-silanamine is present in an amount of from about 1 to about 20 weight percent.

18. A hydrophobic intermediate transfer member connected to a photoconductor wherein said member consists of, in sequence, a supporting substrate, an adhesive layer, and thereover a layer which consists of a core shell component of a titanium oxide core with a silica shell thereover wherein said core shell is contained in a fluoroelastomer, and wherein said shell consists of said silica and a trialkyl-N-(trialkylsilyl)-silanamine selected from the group consisting of 1,1,1-trimethyl-N-(trimethylsilyl)-silanamine, hexamethyldisilazane, 2,2,4,4,6,6-hexamethylcyclotrisilazane, 1,3-diethyl-1,1,3, 3-tetramethyldisilazane, 1,1,3,3-tetramethyl-1,3-diphenyldisilazane, and 1,3-dimethyl-1,1,3,3-tetraphenyl disilazane and wherein said member accepts a xerographic developed image from said photoconductor, and wherein said developed image is subsequently transferred to a document.

19. An intermediate transfer member in accordance with claim 18 wherein said trialkyl-N-(trialkylsilyl)-silanamine is 1,1-trimethyl-N-(trimethylsilyl)-silanamine, and said fluoroelastomer is a copolymer of vinylidene fluoride and hexafluoropropylene, a terpolymer of vinylidene fluoride, hexafluoropropylene and tetrafluoroethylene, or a tetrapolymer of vinylidene fluoride, hexafluoropropylene, tetrafluoroethylene, and a cure site monomer of 4-bromoperfluorobutene-1, 1,1-dihydro-4-bromoperfluorobutene-1, 3-bromoperfluoro propene-1, or 1,1-dihydro-3-bromoperfluoropropene-1.

20. An intermediate transfer belt consisting essentially of a supporting substrate having deposited thereon a mixture of a fluoroelastomer, and a core shell component of a titanium oxide core with a silica shell thereover and wherein said shell includes 1,1,1-trimethyl-N-(trimethylsilyl)-silanamine, and wherein said fluoroelastomer is a copolymer of vinylidene fluoride and hexafluoropropylene, a terpolymer of vinylidene fluoride, hexafluoropropylene and tetrafluoroethylene, or a tetrapolymer of vinylidene fluoride, hexafluoropropylene, tetrafluoroethylene, and a cure site monomer of 4-bromoperfluorobutene-1, 1,1-dihydro-4-bromoperfluorobutene-1, 3-bromoperfluoropropene-1, or 1,1-dihydro-3-bromoperfluoropropene-1 and an adhesive layer situated between said supporting substrate and said core shell, said core shell being of a particle size diameter of from about 10 to about 200 nanometers, and wherein said member accepts a xerographic developed image from a photoconductor, and wherein said developed image is subsequently transferred to a substrate.

* * * * *